United States Patent [19]

Grant

[11] Patent Number: 4,606,275

[45] Date of Patent: Aug. 19, 1986

[54] TAMPING TOOLS

[76] Inventor: Michael R. Grant, 112 Cedarbrook La., Haughton, La. 71037

[21] Appl. No.: 803,609

[22] Filed: Nov. 27, 1985

Related U.S. Application Data

[63] Continuation-in-part of Ser. No. 664,545, Oct. 25, 1984.

[51] Int. Cl.[4] ..... E01B 27/16

[52] U.S. Cl. ..... 104/10; 37/142 R; 172/745; 172/772; 403/16

[58] Field of Search ..... 104/10, 12–14; 172/745, 772, 713, 719, 762; 403/16, 11, 261; 37/142 R, 141 R, 141 T; 294/57

[56] References Cited

U.S. PATENT DOCUMENTS

| | | | |
|---|---|---|---|
| 174,449 | 3/1876 | Trissler | 172/745 |
| 2,726,871 | 12/1955 | Schnellmann | 104/10 X |
| 3,581,664 | 6/1971 | Kruse et al. | 104/10 |
| 3,677,187 | 7/1972 | Stewart | 104/10 |
| 3,729,055 | 4/1973 | Burridge | 104/10 X |
| 3,774,324 | 11/1973 | Lafond | 37/142 R |
| 3,826,025 | 7/1974 | Elliott | 104/12 X |
| 4,062,291 | 12/1977 | Vick et al. | 104/10 |
| 4,068,594 | 1/1978 | Crowell | 104/10 |
| 4,167,141 | 9/1979 | Haywood | 104/10 |

FOREIGN PATENT DOCUMENTS

| | | | |
|---|---|---|---|
| 2723551 | 11/1978 | Fed. Rep. of Germany | 104/10 |

*Primary Examiner*—Randolph A. Reese

*Attorney, Agent, or Firm*—John M. Harrison

[57] ABSTRACT

Tamping tools for mounting in a ballast tamping apparatus such as the rail-mounted Canron, Plasser and Jackson ballast tamping machines designed for tamping ballast around railroad cross ties, which tamping tools each include a shaft adapted for mounting on a reciprocating mechanism in a respective ballast tamping machine, a shaped shank extending from the shaft, a weld ring or nut seated on the shank and welded to the shaft and a tool foot having a receptacle internally configured to receive the shaped shank, with the tool foot welded to the weld ring or nut for easy replacement. A blade is provided at the extending end of the tool foot in offset relationship for contacting and tamping the ballast and in a first embodiment the blade is formed integrally with the foot, while in a second embodiment the blade is bolted to the tool foot.

37 Claims, 8 Drawing Figures

TAMPING TOOLS

CROSS-REFERENCE TO RELATED APPLICATIONS

This application is a continuation-in-part of my co-pending U.S. patent application Ser. No. 664,545, filed Oct. 25, 1984 and is related to my co-pending U.S. patent application Ser. No. 624,349, filed June 25, 1984, and to my U.S. patent application Ser. No. 598,026, filed Apr. 9, 1984, now abandoned.

BACKGROUND OF THE INVENTION

1. Field of the Invention

In the patent applications identified above, I disclose metal tamping tools for mounting in ballast tamping apparatus of various design, each of which tools includes a shaft for mounting on the reciprocating mechanism in a specific tamping apparatus and at least one shank having a cross-section of selected shape extending from the shaft, with a tool foot removably pinned to the shank. A blade is provided on the extended end of the tool foot for tamping the ballast responsive to operation of the ballast apparatus.

This invention relates to railroad ballast tamping equipment and more particularly, to metal tamping tools which are designed for use in ballast tamping machines of various design and include a shaft configured to mount in the ballast tamping machine of choice, a shaped shank extending from the shaft, a weld ring or nut fitted on the shank and welded to the shaft and a hollow tool foot seated on the shank and welded to the weld ring. In a first preferred embodiment the tool foot is integrally formed with a tamping blade which is offset from the longitudinal centerline of the tool foot and the tool foot is internally configured to fit a tapered shank. Since the tool foot is welded in position on the shank using a weld ring or nut, it is easily replaced by cutting the weld with a torch when the blade is worn to an undesirable extent. The shaft of the tamping tool is designed to fit the reciprocating mechanisms on such automatic tamping machines as the "Jackson", "Plasser", and "Canron" ballast tamping machines, in non-exclusive particular. Furthermore, in a second preferred embodiment of the invention the blade portion of the tool foot is secured to the tool foot by means of bolts or cap screws. The tamping tools of this invention generally include a tool base or shaft which is adapted to mount in one or more of the respective tamping machines, which shaft is fitted with a rigid, tapered shank of uniform design and configured to receive a weld ring or nut and a tool foot having a tapered receptacle. The tool foot is welded to the weld ring or nut, which weld ring or nut is, in turn, welded to the tool shaft in order to facilitate rapid and convenient replacement of the tool foot by cutting the tool foot from the shank at the weld ring or nut.

2. Description of the Prior Art

Ballast tamping tools for packing and securing ballast against and under rail cross-ties in railroad beds are well known in the art. In recent years such tools have been mounted on reciprocating outriggers attached to rail-mounted tamping machines of various description. The outriggers are positioned over the extending ends of the railroad cross-ties and multiple tamping tools, which are bolted or otherwise attached to the outriggers, project downwardly toward the ballast located around, between and beneath the cross-ties. A blade is typically formed integrally with, or is welded or bolted to the extending end of a tool shaft in each of the tamping tools and multiple blades are sequentially plunged into the ballast at points adjacent the cross-ties to pack the ballast around and under the cross-ties as the tool shafts are reciprocated and laterally articulated by the outrigger mechanism. When the ballast is tightly packed around cross-ties spanned by the machine outriggers, the tamping tools are retracted and the tamping machine apparatus is advanced on the rails to locate the tamping tools over cross-ties spanning unpacked ballast.

One of the problems currently existing in automatic tamping machines used to pack ballast around cross-ties in railroad beds is the lack of facility to quickly replace worn tamping tool blades. In a typical blade installation multiple blades are bolted or otherwise attached by means of the tool shafts to reciprocating outriggers in the tamping machines and the blades and tool feet are usually formed in one piece, such that the entire tamping tool must be replaced when the blade wears to an undesirable extent. An alternative solution to the problem of blade wear is to cut the worn blade from the projecting tamping tool with a cutting torch and weld another blade in its place. However, this operation usually cannot be accomplished with the tamping tool mounted on the tamping machine and the time required to weld the new blade onto the tool shaft may exceed the time of removal of the old tool and reattachment of the new tamping tool to the machine. Other solutions to the problem include bolting the blade to the tool foot and periodically replacing the worn blade with a new one. However, experience has shown that under most circumstances irregular wearing of the tool blade frequently destroys either the heads of the connecting bolts or that portion of the foot or shank which supports the blade, rendering replacement of the blade either difficult or impossible.

Tamping tools of various design for use in track ballast tamping or packing machines are known in the art. Typical of these designs is the tool disclosed in U.S. Pat. No. 2,726,871, dated Dec. 13, 1955, to F. Schnellmann and entitled "Attachment of Picks on Track-Packing Machines". This patent details the attachment of a pick or tamping device on track packing machines, wherein that segment of the pick which is clamped on the machine is smooth and cylindrical in shape and engages a slotted sleeve in the pick arm, the slotted sleeve tightened by multiple screws to effect gripping of the pick at longitudinally separated points. U.S. Pat. No. 3,677,187, dated July 18, 1972, to John K. Stewart discloses a "Reversible Tamping Bar" which includes a pair of elongated tamping tool supports with lateral bores adapted for alignment with a common nose bore to receive a bolt for securing the supports on each side of a nose member. The nose member is provided with four inwardly inclined faces for mating with inclined faces in the supports, such that any tendency of the supports to move upwardly places the bolt in tension. A "Ground Engaging Unit for Ballast Tamping Machines" is disclosed in U.S. Pat. No. 3,826,025, dated July 30, 1974, to William A. Elliott. This device includes an upper shaft for connection to a tamping machine and a lower portion for receiving a replaceable shoe. In one embodiment the shoe is attached to the shaft in a wedge-fit and in another embodiment an adhesive is used to effect the desired connection. Another "Tamping Tool" is disclosed in U.S. Pat. No. 4,068,594, dated Jan. 17, 1978, to James E. Crowell, which tool is characterized by a shank and a detachable blade. In one embodiment of the disclosure a detachable wedge is inserted between the upper portion of the foot member and the shank and in a second embodiment, an arcuate joint is provided between the foot member and the shank. The upper portion of the shank is designed to mate with a reciprocating member in a tamping machine. U.S. Pat. No. 4,167,141, dated Sept. 11, 1979, to Glen H. Haywood details a "Percussive Tool With Replaceable Work Bit". This tool includes a replaceable tamping foot for mounting in a shank by a tapered force fit. A repulsive force is generated between the shank and the tamping foot by means of a grease gun to remove the foot from the shank. German Pat. No. 2,723,551 details a pick shaft designed for mounting in a railroad track compacting machine and provided with a cavity which receives a projecting pin mounted in a tool foot, for removably securing the tool foot on the pick shaft.

It is an object of this invention to provide tamping tools having improved removable and replaceable tool feet and blade segments for use in railroad ballast tamping machines.

Another object of the invention is to provide new and improved metal tamping tools which are designed for mounting in various ballast tamping machines and are each characterized by a shaft configured to mount on a tamping machine of selected design, a unitary, hollow tool foot and offset blade which are designed for maximum strength and efficiency and a shank extending from the shaft and configured to receive both a weld ring or nut and the tool foot, which weld ring or nut is welded to the shaft and to the tool foot.

Still another object of this invention is to provide a tamping tool for use in automatic ballast tamping machines such as the Canron, Plasser and Jackson machines, in non-exclusive particular, which tool includes a shaft configured to mount in the machine, a round, tapered shank formed integrally with the shaft and provided with a weld ring or nut at the upper end, which weld ring or nut is welded to the shaft, a foot member having an internal receptacle shaped to receive the shank and also welded to the weld ring or nut and a unitary, offset blade shaped in the extending end of the foot member.

Still another object of this invention is to provide improved tamping tools for attachment to a ballast tamping apparatus, and more particularly, tamping tools which include a shaft adapted for attachment to a reciprocating outrigger in the tamping apparatus, a shank member having a tapered and extending from the shaft, a weld ring or nut fitted on the shank member and welded to the shaft and an improved tool foot having a receptacle designed to snugly receive the shank member and welded to the weld ring or nut, the tool foot also carrying an offset tamping blade, with a bolt or cap screw securing the tamping blade to the tool foot in order to facilitate easy replacement of the tamping blade and the tool foot as a result of wear in the tamping blade.

Another object of the invention is to provide a new and improved tamping tool for use in automatic ballast tamping machines, which tool is characterized by a shaft provided with a shaped upper end for removable attachment to a ballast tamping machine, a round, tapered shank extending from the shaft, a weld ring slidably fitted on the shank and welded to the shaft and an improved tool foot having a tapered internal cavity in a receiving end and a blade bolted on the opposite end in offset relationship with respect to the longitudinal centerline of the tool foot, the receiving end of which tool foot is seated on the tapered shank and welded to the weld ring, wherein the tamping tool can be selectively unbolted from the tamping machine, the tool foot cut from the weld ring with a torch and then removed from the tamping tool shank and the blade unbolted from the tool foot, as desired.

Yet another object of this invention is to provide a tamping tool which is characterized by exceptional strength and ease of maintenance and includes a shaft having one end configured for attachment to a ballast tamping machine of corresponding design and the opposite end including a round, tapered shank which slidably receives a cooperating weld ring or nut which is welded to the shaft, the shank also designed to receive and mount a hollow tool foot by welding the tool foot to the weld ring or nut. A blade segment is optionally attached to the tool foot by means of bolts or cap screws, welded to the tool foot, or is formed integrally with the tool foot.

Another object of this invention is to provide an improved tamping tool for attachment to a ballast tamping apparatus, which tool includes a base or shaft configured and adapted for attachment to a reciprocating outrigger in the tamping apparatus, a round, shaped shank projecting from the shaft, a weld nut fitted on the shank and welded to the shaft and a foot having a hollow interior also fitted on the shank and welded to the weld nut, the foot carrying a flange fitted with a shaped tamping blade which is offset from the longitudinal centerline of the foot.

A still further object of the invention is to provide a new and improved tamping tool which is characterized by a shaped shank extending from a base or shaft member configured to mount in a ballast tamping machine; a weld ring or nut fitted on the shank and welded to the shaft; a tool foot member having an internal cavity configured to snugly receive the shaped shank and also welded to the weld ring or nut and a blade flange carrying a tamping blade and provided with an opening to threadibly receive a bolt or capscrew and removably retain the tamping blade on the shaped shank.

SUMMARY OF THE INVENTION

These and other objects of the invention are provided in metal tamping tools for use in automatic ballast tamping machines, which tools each include an elongated base or shaft having one end shaped and adapted to cooperate with a selected tamping machine and the other end configured to define a round shank of reduced diameter and having a tapered end. A weld ring or nut is slidably fitted on the shank and is welded to the shaft and the shank is configured to register with a shaped receiving receptacle provided in one end of a tool foot, which tool foot is also welded to the weld ring or nut and fixedly carries an offset tamping blade at the opposite end. In a most preferred embodiment of the invention a removable, offset-mounted tamping blade is attached to the opposite end of the tool foot by means of cap screws.

BRIEF DESCRIPTION OF THE DRAWINGS

The invention will be better understood by reference to the accompanying drawings, wherein.

DESCRIPTION OF THE PREFERRED EMBODIMENTS

Figure 1:
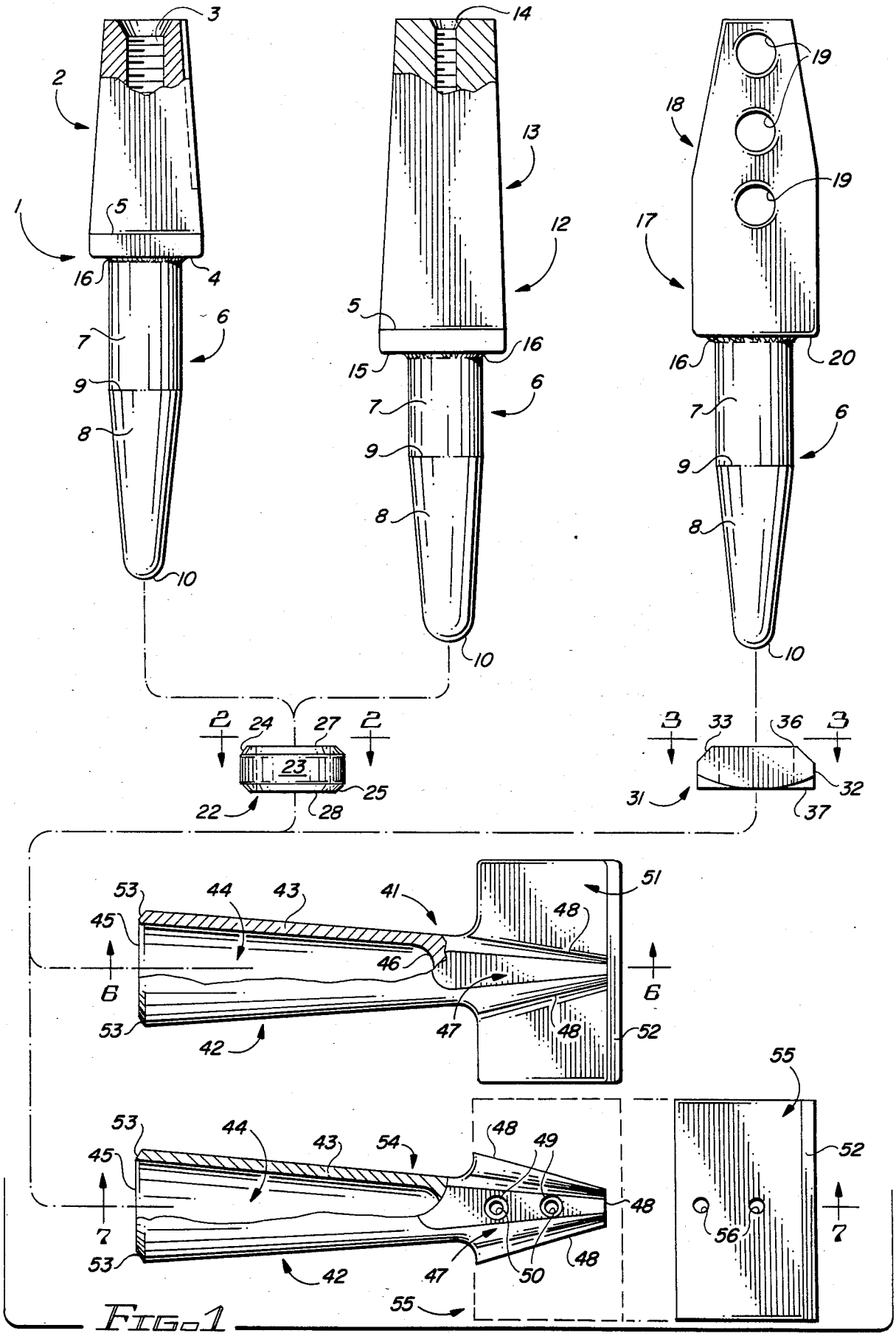
FIG. 1 is an exploded view of various tamping tools designed to fit the Canron, Plasser and Jackson tamping tools according to this invention.

Referring initially to FIG. 1 of the drawings, various cast iron or steel tamping tools are used by way of illustration according to this invention, including the Canron tamping tool 1, the Plasser tamping tool 12 and the Jackson tamping tool 17. The Canron tamping tool 1 is characterized by a conventional round, tapered Canron shaft 2, provided with a threaded longitudinal Canron mount aperture 3 for connecting the Canron shaft 2 to a Canron tamping machine (not illustrated). The taper in the round Canron shaft 2 terminates at a shoulder margin 5 which defines a Canron shaft shoulder 4, from which a specially designed round shank 6 depends. The shank 6 is characterized by a shank base 7 of substantially uniform diameter, which diameter is smaller than the diameter of the Canron shaft 2 at the Canron shaft shoulder 4. The shank base 7 joins the Canron shaft shoulder 4 at a shoulder radius 16 and terminates at a leg margin 9, from which a shank leg 8 extends. The shank leg 8 is in turn terminated by a rounded shank tip 10 and in a preferred embodiment of the invention, the shank 6 is formed integrally with the conventional Canron shaft 2 by casting or forging production processes which are well known to those skilled in the art.

The Plasser tamping tool 12 is characterized by a round, tapered Plasser shaft 13, provided with a threaded Plasser mount aperture 14 for securing the Plasser shaft 13 to a conventional Plasser tamping machine (not illustrated). The taper in the Plasser shaft 13 terminates at the shoulder margin 5, as in the Canron shaft 2 and a Plasser shaft shoulder 15 of substantially uniform diameter terminates the lower end of the Plasser shaft 13. A round shank 6 extends from the Plasser shaft shoulder 15 and, as in the case of the Canron tamping tool 1, the shank 6 is characterized by a shank base 7 of substantially uniform diameter, which diameter is less than the diameter of the Plasser shaft 13 at the Plasser shaft shoulder 15. The shank base 7 joins the Plasser shaft shoulder 15 at a shoulder radius 16 and terminates at a leg margin 9 and the tapered shank leg 8 extends from the shank base 7 at the leg margin 9 and is terminated by a rounded shank tip 10.

A Jackson tamping tool 17, having a generally square or rectangular shaped cross-sectional configuration, includes a Jackson shaft 18, provided with transverse Jackson mount apertures 19 for securing the Jackson shaft 18 to a Jackson tamping machine (not illustrated). A Jackson shaft shoulder 20 is defined at the extreme bottom portion of the Jackson shaft 18 and a round shank 6 extends from the Jackson shaft shoulder 20, as in the case of the Canron tamping tool 1 and the Plasser tamping tool 12. The shank 6 is also characterized by a shank base 7 of substantially uniform diameter, which diameter is less than the width of the Jackson shaft 18 at the Jackson shaft shoulder 20. The shank base 7 joins the Jackson shaft shoulder 20 at a shoulder radius 16 and terminates in a leg margin 9 and is extended at the leg margin 9 by a shank leg 8, which tapers to a shank tip 10.

Figure 6:
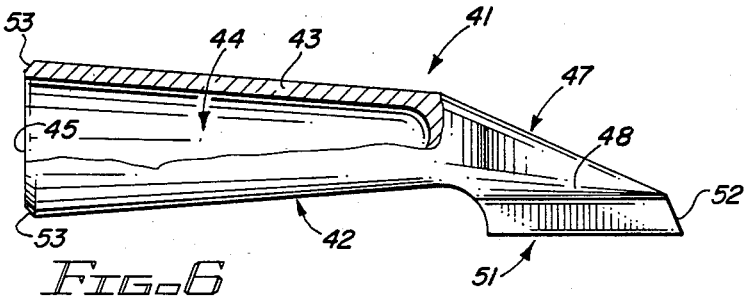
FIG. 6 is a side elevation, partially in section, of a typical fixed tool foot used in the tamping tool of this invention.
Figure 7:
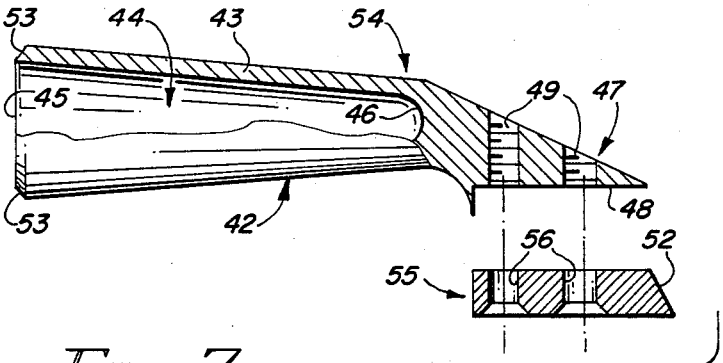
FIG. 7 is a side elevation, partially in section, of a typical removable tool foot used in the tamping tool of this invention.

Both the Canron tamping tool 1 and the Plasser tamping tool 12 are designed to receive either a fixed tool foot 41 or a removable tool foot 54 by means of a weld ring 22, as illustrated in FIGS. 1, 6 and 7. Since the shank 6 in both the Canron tamping tool 1 and the Plasser tamping tool 12 are identical in configuration, both the Canron tamping tool 1 and the Plasser tamping tool 12 are designed to received either the fixed tool foot 41 or the removable tool foot 54 in the manner hereinafter described. The weld ring 22 is designed to slidably engage the shank leg 8 and the shank base 7 of the shank 6 and seat against the Canron shaft shoulder 4 and the Plasser shaft shoulder 15, respectively, in both the Canron tamping tool 1 and the Plasser tamping tool 12, in order to secure either the fixed tool foot 41 or the removable tool foot 54 to the Canron tamping tool 1 and Plasser tamping tool 12, as hereinafter more particularly described. Referring now to the fixed tool foot 41 illustrated in FIGS. 1 and 6, a tapered shaft receptacle 44 is provided in an elongated foot sleeve 42, which characterizes one element of the fixed tool foot 41. The shaft receptacle 44 is shaped and designed to receive both the shank base 7 and the shank leg 8 of the shank 6 in both the Canron tamping tool 1 and the Plasser tamping tool 12, after the weld ring 22 has been inserted on the shank base 7 and lodged against the Canron shaft shoulder 4 in the Canron tamping tool 1, or the Plasser shaft shoulder 15 in the Plasser tamping tool 12. The foot wall 43 in the foot sleeve 42 terminates in a sleeve shoulder 45 at the open end thereof and at a receptacle base 46 at the opposite end, and is of sufficient thickness and strength to facilitate secure mounting of the fixed tool foot 41 on each respective shank 6, while both the Canron tamping tool 1 and the Plasser tamping tool 12 are operated conventionally, according to the knowledge of those skilled in the art. A sleeve shoulder bevel 53 is provided in the periphery of the sleeve shoulder 45 and a fixed blade 51 is integrally formed in the extending end of the foot sleeve 42 and the fixed blade 51, in combination with the foot sleeve 42, define the fixed tool foot 41. In a preferred embodiment of the invention the fixed blade 51 is mounted in offset relationship with respect to the longitudinal centerline of the foot sleeve 42 of the fixed tool foot 41 and is provided with a blade level 52 at the bottom, ballast-containing edge thereof, in order to aid in the tamping operation. An integrally formed sleeve flange 47 depends from the hollow segment of the foot sleeve 42 across the center face of the fixed blade 51, in order to strengthen the fixed blade 51 and the flange margins 48 and define the configuration of the sleeve flange 47 with respect to the fixed blade 51.

As further illustrated in FIGS. 1 and 7 an alternative tool foot is provided in the configuration of the removable tool foot 54, which is also characterized by a tapered shaft receptacle 44 shaped in a foot sleeve 42 which is provided with a foot wall 43 of selected thickness. A sleeve shoulder 45 and cooperating sleeve shoulder bevel 53 terminate the open end of the foot sleeve 42 and as in the case of the fixed tool foot 41, the removable tool foot 54 is characterized by an integrally formed, depending sleeve flange 47 at the opposite end of the foot sleeve 42. However, the sleeve flange 47 in the removable tool foot 54 includes a pair of internally threaded flange apertures 49 extending therethrough for threadably receiving a pair of cap screws 50. A removable blade 55 is shaped generally in the same configuration as the fixed blade 51 and is characterized by countersunk blade apertures 56 for securing the removable blade 55 to the sleeve flange 47 of the fixed blade 51 by means of cap screws 50. When the removable blade 55 is secured to the sleeve flange 47 by the cap screws 50 as illustrated in FIG. 1, the flange margins 48 of the sleeve flange 47 lie essentially in the same general location on the removable blade 55 as the flange margins 48 in the sleeve flange 47 of the fixed tool foot 41. Accordingly, it will be appreciated that the removable blade 55 can be removed from the sleeve flange 47 and the removable tool foot 54 as the blade bevel 52 and removable blade 55 wear during operation of the tamping tools. As in the case of the fixed tool foot 41, in a most preferred embodiment of the invention the removable blade 55 is secured to the sleeve flange 47 of the removable tool foot 54 in offset relationship with respect to the centerline of the foot sleeve 42.

Figure 2:
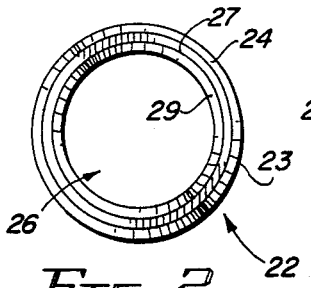
FIG. 2 is a top elevation of a weld ring used to secure a tool foot on the depending shank of the Canron and Plasser tamping tools of this invention.
Figure 4:
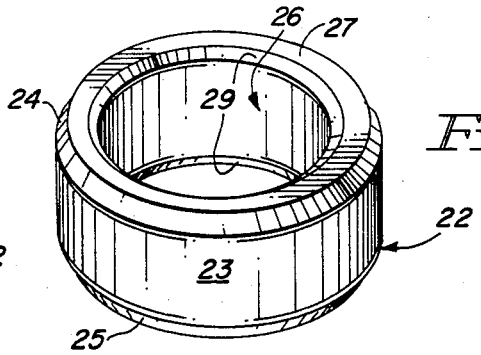
FIG. 4 is a perspective view of the weld ring illustrated in FIG. 2.

Referring now to FIGS. 2 and 4 of the drawings in a most preferred embodiment of the invention the weld ring 22 is characterized by a round ring body 23, provided with a top ring bevel 24 and a corresponding bottom ring bevel 25 and having a smooth ring bore 26 extending through the ring body 23. A flat top ring margin 27 lies between the top ring bevel 24 and an inside ring bevel 29 and a corresponding flat bottom ring margin 28 is sandwiched between the bottom ring bevel 25 and a second inside ring bevel 29. Referring again to FIGS. 1, 3 and 4, when the weld ring 22 is inserted on the shank base 7 of either the Canron tamping tool 1 or the Plasser tamping tool 12, the inside ring bevel 29 receives the shoulder radius 16 and the top ring margin 27 seats against the Canron shaft shoulder 4 or the Plasser shaft shoulder 15, respectively. Furthermore, when either the fixed tool foot 41 or the removable tool foot 54 are then inserted on the shank leg 8 and the shank base 7, the sleeve shoulder 45 of the foot sleeve 42 in each case fits flat against the bottom ring margin 28, thus sandwiching the weld ring 22 between the Canron shaft shoulder 4 or the Plasser shaft shoulder 15 and the respective sleeve shoulder 45.

Figure 3:
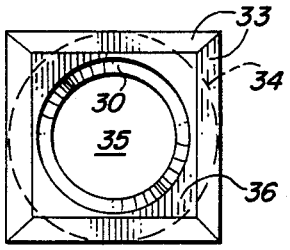
FIG. 3 is a top elevation of a weld nut used to secure a tool foot on the shank of the Jackson tamping tool according to this invention.
Figure 5:
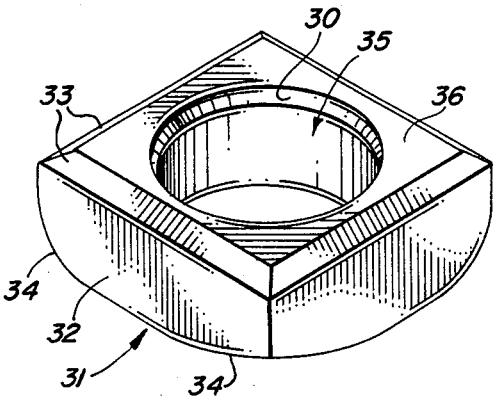
FIG. 5 is a perspective view of the weld nut illustrated in FIG. 3.

Referring now to FIGS. 3 and 5 of the drawings in another preferred embodiment of the invention the weld nut 31 is characterized by a square nut body 32 provided with a top nut bevel 33 and a bottom nut bevel 34, respectively, on all four sides. A smooth nut bore 35 extends through the nut body 32, an inside nut bevel 30 is provided in the top margin of the nut bore 35 and a flat top nut margin 36 is located between the inside nut bevel 30 and the top nut bevel 33. A flat bottom nut margin 37 lies adjacent the nut bore 35 on the opposite side of the nut body 32 and extends to the contoured bottom nut bevel 34. Referring again to FIGS. 1, 3 and 5 of the drawings when the weld nut 31 is inserted on the shank base 7 of the Jackson tamping tool 17, the inside nut bevel 30 accommodates the shoulder radius 16 in the Jackson shaft shoulder 20 and the top nut margin 36 is positioned against the Jackson shaft shoulder 20. Subsequently, either the fixed tool foot 41 or the removable tool foot 54 can be inserted on the shank leg 8 and the shank base 7 of the shank 6 in the Jackson tamping tool 17 until the sleeve shoulder 45 fits flat against the bottom nut margin 37 of the weld nut 31.

Figure 8:
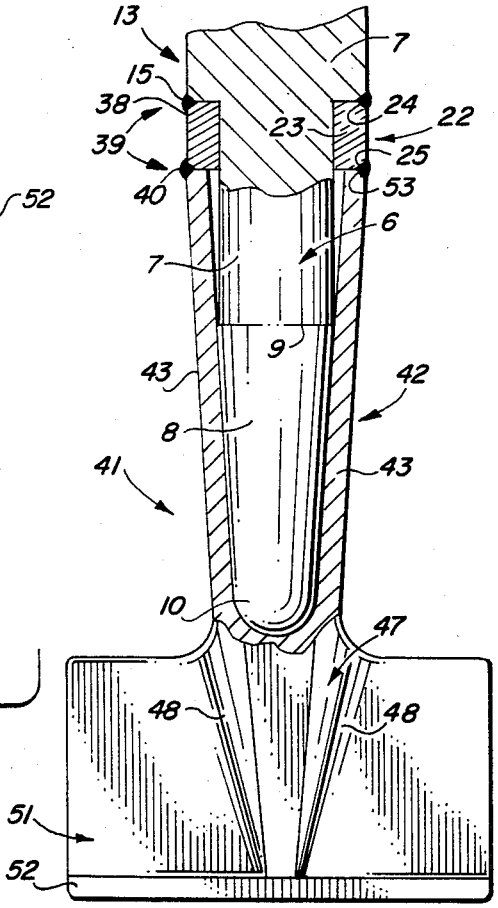
FIG. 8 is a rear elevation, partially in section, of the fixed tool foot located in position for welding on the shank of a tamping tool according to this invention.

Referring now to FIGS. 1, 3, 4 and 8 of the drawings when it is desired to use the weld ring 22 to secure a fixed tool foot 41 to the shank 6 of a Plasser tamping tool 12, the weld ring 22 is initially inserted on the shank base 7 of the shank 6 until the top ring margin 27 lies flat against the Plasser shaft shoulder 15, as illustrated in FIG. 8. The shank leg 8 and shank base 7 of the shank 6 are then inserted in the shaft receptacle 44 of the fixed tool foot 41 until the sleeve shoulder 45 lies against the bottom ring margin 28 of the weld ring 22, as further illustrated in FIG. 8. When the fixed tool foot 41 is in the relative position illustrated in FIG. 8, the shank tip 10 lies against the receptacle base 46 of the shaft receptacle 44 such that the shank 6 fits snugly, yet removably, inside the contour of the shaft receptacle 44. Accordingly, spaced, parallel and circular weld slots 39 are defined by the top ring bevel 24 and the outer edge of the Plasser shaft shoulder 15 and by the bottom ring bevel 25 and the sleeve shoulder bevel 53, respectively. A shaft weld 38 and foot weld 40 (illustrated in phantom) are provided in the weld slots 39, respectively, to secure the fixed tool foot 41 to the Plasser shaft 13.

Similarly, and referring again to FIGS. 1, 3 and 5, it will be appreciated that the weld nut 31 can also be slipped on the shank 6 of the Jackson shaft 18 in the Jackson tamping tool 17 and either the fixed tool foot 41 or the removable tool foot 54 inserted on the shank 6 to create a pair of weld slots 39 at the top nut bevel 33 and at the bottom nut bevel 34 and corresponding sleeve shoulder bevel 53. An additional shaft weld 38 and foot weld 40 are provided in these weld slots 39, respectively, to secure either the fixed tool foot 41 or the removable tool foot 54 to the Jackson shaft 18 of the Jackson tamping tool 17.

It will be appreciated by those skilled in the art that the tamping tools of this invention are characterized by great convenience and flexibility in that either the specially designed fixed tool foot 41 or removable tool foot 54 can be used on the Canron tamping tool 1, the Plasser tamping tool 12 and the Jackson tamping tool 17, as well as any other tamping tool which utilizes a cooperating, shaped shank 6 according to the teaching of this invention. Furthermore, the removable tool foot 54 offers an additional convenience in replacement of the removable blade 55 due to wear by simply removing the cap screws 50, discarding the worn removable blade 55 and inserting a new removable blade 55 on the sleeve flange 47 of the removable tool foot 54. Referring again to FIG. 8, when it is desired to replace the fixed tool foot 41 due to excessive wear in the fixed blade 51, the foot weld 40 in the bottom one of the weld slots 39 is heated with a torch to cut the foot weld 40 away, in order to facilitate removal of the fixed tool foot 41 from the shank 6. When this is accomplished, a new fixed tool foot 41 can be inserted on the shank 6 and a new foot weld 40 applied to the bottom one of the weld slots 39 and this operation can be undertaken in the field without the necessity of moving the tamping machine to a machine shop or other point of repair. It is understood that under circumstances where multiple foot welds 40 are applied to the bottom one of the weld slots 39, in the course of replacing either the fixed tool foot 41 or the removable tool foot on several occasions, either the weld ring 22 or the weld nut 31 may become crystalized and unable to securely retain the fixed tool foot 41 or the removable tool foot 54 on the shank 6. Under these circumstances, a torch is applied to the shaft weld 38 located at the top weld slots 39 and the shaft weld 38 is cut away to remove either the weld ring 22 or the weld nut 31, as the case may be. After this operation is accomplished, a new weld ring 22 or weld nut 31 can be inserted on the shank base 7 and rewelded at the top one of the weld slots 39 to the Canron shaft shoulder 4, Plasser shaft shoulder 15 or the Jackson shaft shoulder 20 or other tamping machine shaft, as the case may require. Subsequently, either the fixed tool foot 41 or the removable tool foot 54 is inserted on the shank 6 and welded to the weld ring 22 or the weld nut 31, as applicable and as heretofore described.

Referring again to FIGS. 1 and 6–8 of the drawings, the design of both the fixed tool foot 41 and the removable tool foot 54 facilitates failure of the foot sleeve 42 at or near the receptacle base 46 in the event that either the fixed blade 51 or the removable blade 55 strike an unyielding object during the ballast tamping operation. This failure occurs in the relatively thin foot wall 43 of the foot sleeve 42 and is calculated to prevent damage to the Canron shaft 2, Plasser shaft 13 and the Jackson shaft 18.

While the preferred embodiments of the invention have been described above it will be recognized and understood that various modifications may be made therein and the appended claims are intended to cover all such modifications which may fall within the spirit and scope of the invention.

Having described my invention with the particularity set forth above, what is claimed is:

1. A tamping tool for a ballast tamping apparatus comprising a shaft having one end adapted for mounting in the ballast-tamping apparatus; a shank extending from the opposite end of said shaft; weld ring means inserted on said shank and located against said opposite end of said shaft; a tool foot and an interior receptacle extending into one end of said tool foot, said interior receptacle shaped to receive said shank with said one end of said tool foot seated against said weld ring means; blade means provided on the opposite end of said tool foot; a first weld connecting said opposite end of said shaft to said weld ring means; and a second weld connecting said one end of said tool foot to said weld ring means, whereby said tool foot is secured to said shaft.

2. The tamping tool of claim 1 wherein said weld ring means further comprises a substantially round ring body, a top ring bevel extending around the top peripheral margin of said ring body and a bottom ring bevel extending around the bottom peripheral margin of said ring body and wherein said first weld is substantially coextensive with said top ring bevel and said second weld is substantially coextensive with said bottom ring bevel.

3. The tamping tool of claim 1 wherein said shank is characterized by a base segment having a substantially uniform cross-section and a tapered leg segment projecting from said base segment.

4. The tamping tool of claim 1 wherein:

(a) said weld ring means further comprises a substantially round ring body, a top ring bevel extending around the top peripheral margin of said ring body and a bottom ring bevel extending around the bottom peripheral margin of said ring body and wherein said first weld is substantially coextensive with said top ring bevel and said second weld is substantially coextensive with said bottom ring bevel; and (b) said shank is characterized by a base segment having a substantially uniform cross-section and a tapered leg segment projecting from said base segment.

5. The tamping tool of claim 1 wherein said blade means is characterized by a generally rectangular-shaped blade integrally formed in said opposite end of said tool foot in offset relationship with respect to the longitudinal centerline of said tool and further comprising a blade bevel in said blade for contacting and tamping ballast.

6. The tamping tool of claim 1 wherein:

(a) said weld ring means further comprises a substantially round ring body, a top ring bevel extending around the top peripheral margin of said ring body and a bottom ring bevel extending around the bottom peripheral margin of said ring body and wherein said first weld is substantially coextensive with said top ring bevel and said second weld is substantially coextensive with said bottom ring bevel;

(b) said shank is characterized by a base segment having a substantially uniform cross-section and a tapered leg segment projecting from said base segment; and (c) said blade means is characterized by a generally rectangular-shaped blade integrally formed in said opposite end of said tool foot in offset relationship with respect to the longitudinal centerline of said tool foot and further comprising a blade bevel in said blade for contacting and tamping ballast.

7. The tamping tool of claim 1 further comprising a shoulder bevel extending around the top peripheral margin of said one end of said tool foot and wherein said second weld is substantially coextensive with said shoulder bevel.

8. The tamping tool of claim 1 further comprising a shoulder bevel extending around the top peripheral margin of said one end of said tool foot and wherein said weld ring means further comprises a substantially round ring body, a top ring bevel extending around the top peripheral margin of said ring body and a bottom ring bevel extending around the bottom peripheral margin of said ring body and wherein said first weld is substantially coextensive with said top ring bevel and said second weld is substantially coextensive with said bottom ring bevel and said shoulder bevel.

9. The tamping tool of claim 8 wherein said shank is characterized by a base segment having a substantially uniform cross-section and a tapered leg segment projecting from said base segment.

10. The tamping tool of claim 9 wherein said blade means is characterized by a generally rectangular-shaped blade integrally formed in said opposite end of said tool foot in offset relationship with respect to the longitudinal centerline of said tool foot and further comprising a blade bevel in said blade for contacting and tamping ballast.

11. The tamping tool of claim 9 wherein said blade means is characterized by a generally rectangular-shaped blade having a blade bevel disposed along a working edge thereof; at least one aperture provided in said blade; at least one internally threaded foot aperture provided in said opposite end of said tool foot; and at least one cap screw provided in registration with said blade aperture and threadably engaging said threaded foot aperture for removably securing said blade to said opposite end of said tool foot.

12. The tamping tool of claim 1 wherein said blade means is characterized by a generally rectangular-shaped blade having a blade bevel disposed along a working edge thereof; at least one blade aperture provided in said blade; at least one internally threaded foot aperture provided in said opposite end of said tool foot; and at least one cap screw provided in registration with said blade aperture and threadably engaging said threaded foot aperture for removably securing said blade to said opposite end of said tool foot.

13. The tamping tool of claim 1 wherein:

(a) said weld ring means further comprises a substantially round ring body, a top ring bevel extending around the top peripheral margin of said ring body and a bottom ring bevel extending around the bottom peripheral margin of said ring body and wherein said first weld is substantially coextensive with said top ring bevel and said second weld is substantially coextensive with said bottom ring bevel;

(b) said shank is characterized by a base segment having a substantially uniform cross-section and a tapered leg segment projecting from said base segment; and (c) said blade means is characterized by a generally rectangular-shaped blade having a blade bevel disposed along a working edge thereof; at least one blade aperture provided in said blade; at least one internally threaded foot aperture provided in said opposite end of said tool foot; and at least one cap screw provided in registration with said blade aperture and threadably engaging said threaded foot aperture for securing said blade means to said opposite end of said tool foot.

14. The tamping tool of claim 1 wherein said weld ring means further comprises a substantially square weld nut body, a top nut bevel extending around the top peripheral margin of said nut body and a bottom nut bevel extending around the bottom peripheral margin of said nut body and wherein said first weld is substantially coextensive with said top nut bevel and said second weld is substantially coextensive with said bottom nut bevel.

15. The tamping tool of claim 14 wherein said shank is characterized by a base segment having a substantially uniform cross-section and a tapered leg segment projecting from said base segment.

16. The tamping tool of claim 14 wherein said blade means is characterized by a generally rectangular-shaped blade integrally formed in said opposite end of said tool foot in offset relationship with respect to the longitudinal centerline of said tool foot and further comprising a blade bevel in said blade for contacting and tamping ballast.

17. The tamping tool of claim 14 wherein:

(a) said shank is characterized by a base segment having a substantially uniform cross-section and a tapered leg segment projecting from said base segment; and (b) said blade means is characterized by a generally rectangular-shaped blade integrally formed in said opposite end of said tool foot in offset relationship with respect to the longitudinal centerline of said tool foot and further comprising a blade bevel in said blade for contacting and tamping ballast.

18. The tamping tool of claim 14 further comprising a shoulder bevel extending around the top peripheral margin of said one end of said tool foot and wherein said second weld is substantially coextensive with said shoulder bevel.

19. The tamping tool of claim 14 wherein:

(a) said shank is characterized by a base segment having a substantially uniform cross-section and a tapered leg segment projecting from said base segment; and (b) said blade means is characterized by a generally rectangular-shaped blade having a blade bevel disposed along a working edge thereof; at least one blade aperture provided in said blade; at least one internally threaded foot aperture provided in said opposite end of said tool foot; and at least one cap screw provided in registration with said blade aperture and threadably engaging said threaded foot aperture for securing said blade to said opposite end of said tool foot.

20. The tamping tool of claim 1 further comprising a shoulder bevel extending around the top peripheral margin of said one end of said tool foot and wherein said weld ring means further comprises a substantially square weld nut body, a top nut bevel extending around the top peripheral margin of said nut body and a bottom nut bevel extending around the bottom peripheral margin of said nut body and wherein said first weld is substantially coextensive with said top nut bevel and said second weld is substantially coextensive with said bottom nut bevel and said shoulder bevel.

21. The tamping tool of claim 20 wherein said shank is characterized by a base segment having a substantially uniform cross-section and a tapered leg segment projecting from said base segment.

22. The tamping tool of claim 21 wherein said blade means is characterized by a generally rectangular-shaped blade integrally formed in said opposite end of said tool foot in offset relationship with respect to the longitudinal centerline of said tool foot and further comprising a blade bevel in said blade for contacting and tamping ballast.

23. The tamping tool of claim 21 wherein said blade means is characterized by a generally rectangular-shaped blade having a blade bevel disposed along a working edge thereof; at least one blade aperture provided in said blade; at least one internally threaded foot aperture provided in said opposite end of said tool foot; and at least one cap screw provided in registration with said blade aperture and threadably engaging said threaded foot aperture for securing said blade to said opposite end of said tool foot.

24. A tamping tool for a ballast tamping apparatus comprising a round shaft having one end adapted for mounting in the ballast tamping apparatus; a round shank extending from the opposite end of said shaft, said shank having a diameter smaller than the diameter of said shaft; a weld ring inserted on said shank and located against said opposite end of said shaft; a tool foot and an interior receptacle extending into one end of said tool foot, said interior receptacle shaped to receive said shank, with said one end of said tool foot seated against said weld ring; blade means provided on the opposite end of said tool foot; a first weld connecting said opposite end of said shaft to said weld ring; and a second weld connecting said one end of said tool foot to said weld ring, whereby said tool foot is secured to said shaft.

25. The tamping tool of claim 24 wherein said weld ring further comprises a substantially round ring body, a top ring bevel extending around the top peripheral margin of said ring body and a bottom ring bevel extending around the bottom peripheral margin of said ring body and wherein said first weld is substantially coextensive with said top ring bevel and said second weld is substantially coextensive with said bottom ring bevel.

26. The tamping tool of claim 24 further comprising a shoulder bevel extending around the top peripheral margin of said one end of said tool foot and wherein said second weld is substantially coextensive with said shoulder bevel.

27. The tamping tool of claim 24 further comprising a shoulder bevel extending around the top peripheral margin of said one end of said tool foot and wherein said weld ring further comprises a substantially round ring body, a top ring bevel extending around the top peripheral margin of said ring body and a bottom ring bevel extending around the bottom peripheral margin of said ring body and wherein said first weld is substantially coextensive with said top ring bevel and said second weld is substantially coextensive with said bottom ring bevel and said shoulder bevel.

28. The tamping tool of claim 27 wherein said shank is characterized by a base segment having a substantially uniform cross-section and a tapered leg segment projecting from said base segment.

29. The tamping tool of claim 28 wherein said blade means is characterized by a generally rectangular-shaped blade integrally formed in said opposite end of said tool foot in offset relationship with respect to the longitudinal centerline of said tool foot and further comprising a blade bevel in said blade for contacting and tamping ballast.

30. The tamping tool of claim 28 wherein said blade means is characterized by a generally rectangular-shaped blade having a blade bevel disposed along a working edge thereof; at least one blade aperture provided in said blade; at least one internally threaded foot aperture provided in said opposite end of said tool foot; and at least one cap screw provided in registration with said blade aperture and threadably engaging said threaded foot aperture for removably securing said blade to said opposite end of said tool foot.

31. A tamping tool for a ballast tamping apparatus comprising a shaft having a substantially square cross-section and having one end adapted for mounting in the ballast tamping apparatus; a round shank extending from the opposite end of said shaft; a square weld nut inserted on said shank and located against said opposite end of said shaft; a tool foot and an interior receptacle extending into one end of said tool foot, said interior receptacle shaped to receive said shank, with said one of said tool foot seated against said weld nut; blade means provided on the opposite end of said tool foot; a first weld connecting said opposite end of said shaft to said weld nut; and a second weld connecting said one end of said tool foot to said weld nut, whereby said tool foot is secured to said shaft.

32. The tamping tool of claim 31 wherein said weld nut further comprises a substantially square weld nut body, a top nut bevel extending around the top peripheral margin of said nut body and a bottom nut bevel extending around the bottom peripheral margin of said nut body and wherein said first weld is substantially coextensive with said top nut bevel and said second weld is substantially coextensive with said bottom nut bevel.

33. The tamping tool of claim 31 further comprising a shoulder bevel extending around the top peripheral margin of said one end of said tool foot and wherein said second weld is substantially coextensive with said shoulder bevel.

34. The tamping tool of claim 31 further comprising a shoulder bevel extending around the top peripheral margin of said one end of said tool foot and wherein said weld nut further comprises a substantially square weld nut body, a top bevel extending around the top peripheral margin of said nut body and a bottom nut bevel extending around the peripheral margin of said nut body and wherein said first weld is substantially coextensive with said top nut bevel and said second weld is substantially coextensive with said bottom nut bevel and said shoulder bevel.

35. The tamping tool of claim 34 wherein said shank is characterized by a base segment having a substantially uniform cross-section and a tapered leg segment projecting from said base segment.

36. The tamping tool of claim 35 wherein said blade means is characterized by a generally rectangular-shaped blade integrally formed in said opposite end of said tool foot in offset relationship with respect to the longitudinal centerline of said tool foot and further comprising a blade bevel in said blade for contacting and tamping ballast.

37. The tamping tool of claim 35 wherein said blade means is characterized by a generally rectangular-shaped blade having a blade bevel disposed along a working edge thereof; at least one blade aperture provided in said blade; at least one internally threaded foot aperture provided in said opposite end of said tool foot; and at least one cap screw provided in registration with said blade aperture and threadably engaging said threaded foot aperture for removably securing said blade to said opposite end of said tool foot.

* * * * *